US009147981B2

(12) United States Patent
Oh et al.

(10) Patent No.: US 9,147,981 B2
(45) Date of Patent: Sep. 29, 2015

(54) ELECTRICAL CONNECTOR WITH INSERT

(71) Applicant: Tyco Electronics Corporation, Berwyn, PA (US)

(72) Inventors: Lawrence Se-Jun Oh, Hummelstown, PA (US); Kevin Michael Dalbey, Warminster, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 127 days.

(21) Appl. No.: 13/928,036

(22) Filed: Jun. 26, 2013

(65) Prior Publication Data

US 2015/0004838 A1 Jan. 1, 2015

(51) Int. Cl.
*H01R 13/648* (2006.01)
*H01R 13/6589* (2011.01)
*H01R 12/50* (2011.01)

(52) U.S. Cl.
CPC ..... *H01R 13/6589* (2013.01); *H01R 23/6873* (2013.01)

(58) Field of Classification Search
CPC ..... H01R 23/6873; H01R 23/688; H01R 13/514; H01R 13/65807; H01R 13/658; H01R 13/518; H01R 9/032
USPC ..... 439/607.53, 607.05, 607.09, 607.1, 439/607.12, 607.13, 607.15, 701
See application file for complete search history.

(56) References Cited

U.S. PATENT DOCUMENTS 4,451,107 A * 5/1984 Dola et al. ..... 439/607.1
4,516,815 A * 5/1985 Venable et al. ..... 439/95
4,527,285 A * 7/1985 Kekas et al. ..... 398/164
4,781,604 A * 11/1988 Sadigh-Behzadi et al. ... 439/101
5,190,479 A * 3/1993 Jordi ..... 439/620.22
5,304,964 A * 4/1994 DiMarco ..... 333/181
5,564,949 A * 10/1996 Wellinsky ..... 439/607.37
6,287,149 B1 * 9/2001 Elkhatib et al. ..... 439/607.41
6,780,054 B2 * 8/2004 Yip et al. ..... 439/607.27
6,908,346 B1 * 6/2005 Hyzin ..... 439/682
7,147,491 B1 * 12/2006 Poilasne ..... 439/88
7,481,676 B2 * 1/2009 Walter et al. ..... 439/607.01
7,572,148 B1 * 8/2009 Pepe et al. ..... 439/607.05

OTHER PUBLICATIONS

Brent D. Yohn, Assembly, Socket, Quadrax, 2mm SQ, Aircraft Data Network, RR/RR With Socket Contacts, Drawing No. C-1445693, Jun. 23, 2004, 2 pgs.

Brent D. Yohn, Assembly, Pin, Quadrax, 2mm SQ, Aircraft Data Network, RR/RR, With Pin Contacts, Drawing No. C-1445692, Jun. 23, 2004, 2 pgs.

* cited by examiner

*Primary Examiner* — Neil Abrams
*Assistant Examiner* — Travis Chambers

(57) ABSTRACT

An electrical connector includes a housing having a receptacle, and an electrically conductive insert held by the housing within the receptacle. The electrically conductive insert includes a plurality of module openings. The electrically conductive insert includes electrically conductive segments that extend between adjacent module openings. A plurality of signal modules are held by the electrically conductive insert. Each signal module has two differential pairs of electrical contacts. The signal modules are held by the electrically conductive insert such that the electrical contacts of each signal module extend within a corresponding module opening. The electrically conducive segments of the electrically conductive insert extend between adjacent signal modules to electrically isolate the electrical contacts of the adjacent signal modules from each other.

20 Claims, 8 Drawing Sheets

ELECTRICAL CONNECTOR WITH INSERT

BACKGROUND OF THE INVENTION

The subject matter described and/or illustrated herein relates generally to electrical connectors.

Electrical connectors are commonly used to interconnect a wide variety of electrical components. Presently, the demand for higher performance electrical systems continues to increase. For example, electrical connectors are being tasked with being capable of accommodating ever increasing signal data rates between the electrical components of an electrical system. Examples of such an increased signal data rate include Gigabit Ethernet (GbE) and 10 GbE. But, the signal contacts of at least some existing connectors may be incapable of handling such increased signal data rates. For example, the signal contacts may suffer from unwanted electromagnetic interference when grouped too closely together, which may limit the number of signal contacts contained by the electrical connector and thereby limit the performance of the connector.

BRIEF DESCRIPTION OF THE INVENTION

In an embodiment, an electrical connector includes a housing having a receptacle, and an electrically conductive insert held by the housing within the receptacle. The electrically conductive insert includes a plurality of module openings. The electrically conductive insert includes electrically conductive segments that extend between adjacent module openings. A plurality of signal modules are held by the electrically conductive insert. Each signal module has two differential pairs of electrical contacts. The signal modules are held by the electrically conductive insert such that the electrical contacts of each signal module extend within a corresponding module opening. The electrically conducive segments of the electrically conductive insert extend between adjacent signal modules to electrically isolate the electrical contacts of the adjacent signal modules from each other.

In an embodiment, an electrical connector includes a housing having a receptacle, and an electrically conductive insert held by the housing within the receptacle. The electrically conductive insert includes a plurality of module openings. Each module opening has four contact openings. The electrically conductive insert includes first electrically conductive segments that extend between adjacent module openings and second electrically conductive segments that extend between adjacent contact openings. A plurality of signal modules are held by the electrically conductive insert. Each signal module has two differential pairs of electrical contacts. The signal modules are held by the electrically conductive insert within corresponding module openings such that each electrical contact of each signal module extends within a corresponding contact opening of the corresponding module opening. The first and second electrically conducive segments of the electrically conductive insert extend between adjacent module openings and adjacent contact openings, respectively.

In an embodiment, an electrical connector includes a housing having a receptacle, and an electrically conductive insert held by the housing within the receptacle. The electrically conductive insert includes a metallic body that includes a plurality of module openings. The metallic body of the electrically conductive insert includes electrically conductive segments that extend between adjacent module openings. A plurality of signal modules are held by the electrically conductive insert. Each signal module has two differential pairs of electrical contacts. The signal modules are held by the electrically conductive insert such that the electrical contacts of each signal module extend within a corresponding module opening. The electrically conducive segments of the electrically conductive insert extend between adjacent signal modules to electrically isolate the electrical contacts of the adjacent signal modules from each other.

DETAILED DESCRIPTION OF THE INVENTION

Figure 1:
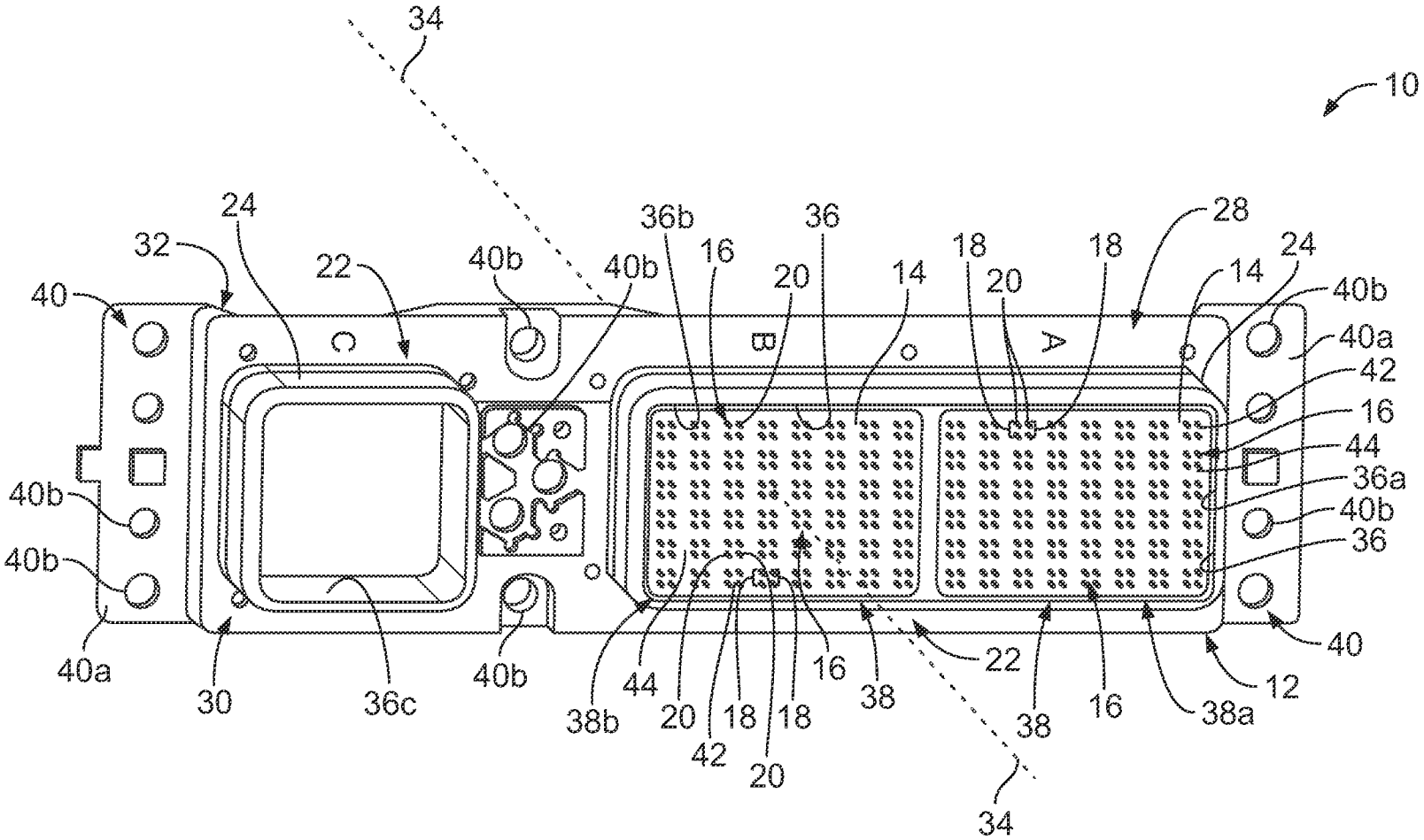
FIG. 1 is a perspective view of an embodiment of an electrical connector.

FIG. 1 is a perspective view of an embodiment of an electrical connector 10. The electrical connector 10 includes a housing 12, one or more electrically conductive inserts 14 held by the housing 12, and a plurality of signal modules 16 held by each electrically conductive insert 14. The signal modules 16 are configured to conduct electrical data signals. For example, each signal module 16 includes two differential pairs 18 of signal contacts 20 that are configured to conduct electrical data signals. Each signal module 16 therefore contains four of the signal contacts 20 in the illustrated embodiment. The signal contacts 20 may be referred to herein as "electrical contacts".

Figure 2:
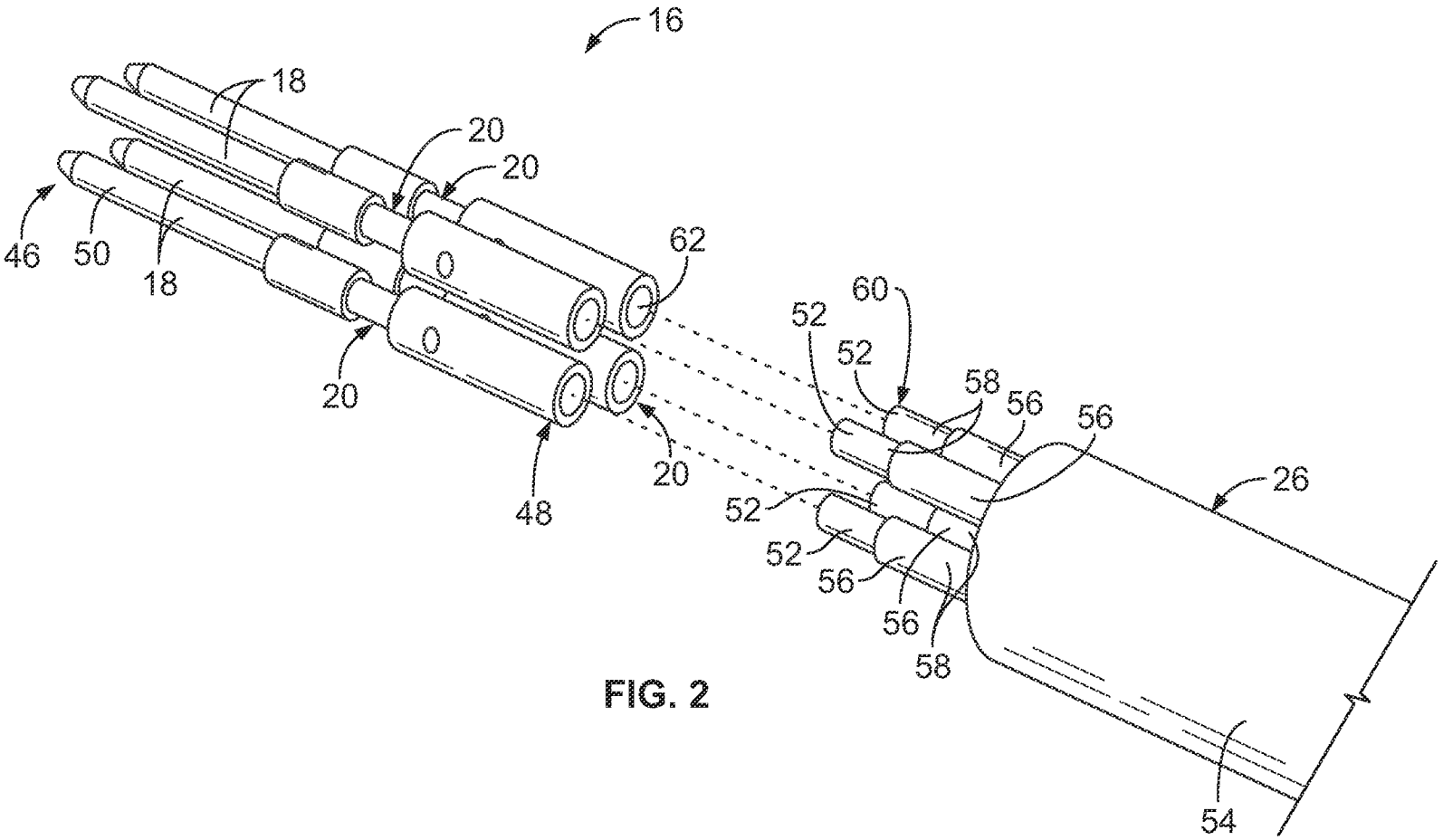
FIG. 2 is an exploded perspective view of an embodiment of a signal module of the electrical connector shown in FIG. 1.
Figure 9:
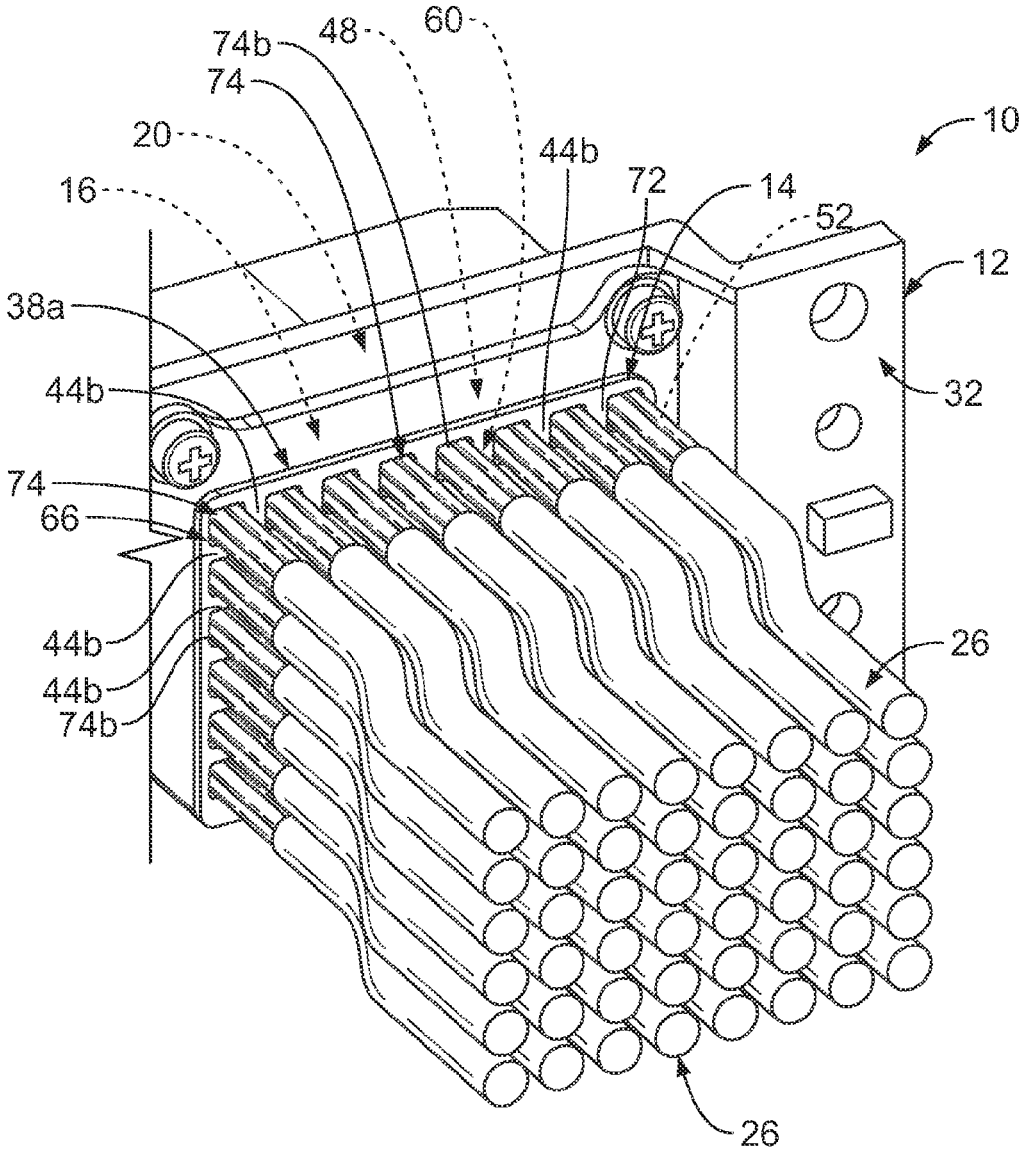
FIG. 9 is a perspective view of a portion of the electrical connector shown in FIG. 1.

The electrical connector 10 mates with a complementary electrical connector (not shown) at a mating interface 22 of the connector 10. In the illustrated embodiment, the housing 12 of the electrical connector 10 includes a plug 24 that is configured to be received within a socket (not shown) of a housing (not shown) of the complementary electrical connector. Alternatively, the housing 12 of the electrical connector 10 includes a socket (not shown) that is configured to receive a plug (not shown) of the housing of the complementary electrical connector or the electrical connector 10 and the complementary electrical connector mate together with a different arrangement than a plug/socket arrangement. In the illustrated embodiment, the electrical connector 10 is configured to terminate one or more electrical cables 26 (FIGS. 2 and 9). Alternatively, the electrical connector 10 is configured to be mounted to a printed circuit board (PCB; not shown) and/or other electrical component.

The housing 12 of the electrical connector 10 includes a body 28 that includes a mating side 30 and an opposite termination side 32. The body 28 of the housing 12 extends from the mating side 30 to the termination side 32 along a central axis 34 of the body 28. The body 28 of the housing 12 includes one or more receptacles 36 for receiving the electrically conductive insert(s) 14. Each electrically conductive insert 14 and the corresponding signal modules 16 held defines a sub-connector 38 of the electrical connector 10.

The body 28 of the housing 12 may include any number of receptacles 36 and may hold any number of sub-connectors 38. In the illustrated embodiment, the body 28 of the housing 12 includes three receptacles 36*a*, 36*b*, and 36*c* for holding three sub-connectors 38. Only two of the sub-connectors 38 are shown in FIG. 1. Rather, the receptacle 36*c* of the body 28 is shown without the corresponding sub-connector 38 held therein for clarity. Although the receptacles 36*a* and 36*b* are shown as having approximately the same relative size and shape for holding sub-connectors 38*a* and 38*b* that have approximately the same relative size and shape, each receptacle 36 may have a different size and/or shape as compared with one or more other receptacles 36 for holding a differently sized and/or shaped sub-connector 38. In other words, the sub-connectors 38 may have different sizes and/or shapes relative to each other. In the illustrated embodiment, the receptacle 36*c* has a different size than the receptacles 36*a* and 36*b* for holding a sub-connector that has a different size as compared to the sub-connectors 38*a* and 38*b*.

In the illustrated embodiment, the body 28 of the housing 12 includes two plugs 24, which extend outward on the mating side 30 along the central axis 34. But, the body 28 of the housing 12 may include any number of the plugs 24, which may or may not be the same as the number of sub-connectors 38 held by the housing 12. In the illustrated embodiment, the housing 12 includes two plugs 24*a* and 24*b* for three sub-connectors 38 because the sub-connectors 38*a* and 38*b* share the plug 24*a*.

The body 28 of the housing 12 optionally includes one or more mounting and/or locking structures 40. The mounting and/or locking structures 40 may be used to mount the electrical connector 10 to another structure, such as, but not limited to, a panel, a wall, a housing, and/or the like. The mounting and/or locking structures 40 may be used to lock (i.e., hold) the electrical connector 10 and the complementary electrical connector together in a mated condition. In the illustrated embodiment, the mounting and/or locking structures 40 include ears 40*a* and openings 40*b* that receive fasteners (not shown). But, the mounting and/or locking structures 40 may additionally or alternatively include any other structure for mounting the electrical connector 10 to another structure and/or for locking the electrical connector 10 with the complementary electrical connector.

Optionally, at least a portion of the body 28 of the housing 12 is electrically conductive, for example for electrically isolating the sub-connectors from nearby electrical components and/or for electrically isolating different sub-connectors 38 of the electrical connector 10 from each other. When the body 28 is electrically conductive, the body 28 of the housing 12 may be engaged in electrical connection with one or more ground shields (not shown, e.g., a cable braid) of the electrical cable(s) 26 or with a ground circuit (not shown) of the PCB and/or other electrical component. The at least a portion of the body 28 that is electrically conductive may be provided as electrically conductive by fabricating the body 28 using any structure, arrangement, configuration, materials, and/or the like. For example, the body 28 may be fabricated from a solid body of one or more metals and/or metal alloys. Another example includes fabricating the body 28 from a dielectric base that is coated (e.g., plated) with an electrically conductive coating. Moreover, and for example, the body 28 may be fabricated from a dielectric base that is at least partially filled with one or more electrically conductive materials.

As will be described in more detail below, the electrically conductive insert 14 of each sub-connector 38 includes electrically conductive segments 44 (better illustrated in FIGS. 3-5, 9, and 10) that electrically isolate adjacent signal modules 16 of the sub-connector 38 from each other. Moreover, the electrically conductive insert 14 of each sub-connector 38 includes electrically conductive segments 42 (better illustrated in FIGS. 3, 5, and 10) that electrically isolate adjacent signal contacts 20 of a signal module 16 from each other, as will also be described below.

FIG. 2 is an exploded perspective view of an embodiment of a signal module 16. As described above, in the illustrated embodiment, the signal module 16 includes two differential pairs 18 of the signal contacts 20 such that the signal module 16 contains four total signal contacts 20. In other embodiments, the signal module 16 may include a different number of differential pairs 18 and/or a different number of the signal contacts 20. Each of the signal contacts 20 may be any type of signal contact having any size, such as, but not limited to, a size 24 signal contact and/or the like.

The signal contacts 20 extend lengths from mating ends 46 to termination ends 48 that are opposite the mating ends 46. The signal contacts 20 are configured to mate with corresponding signal contacts (not shown) of the complementary electrical connector (not shown) at the mating ends 46. In the illustrated embodiment, the mating ends 46 of the signal contacts 20 include pins 50 that are configured to be received within receptacles (not shown) of the corresponding signal contacts of the complementary electrical connector. Alternatively, the mating ends 46 of the signal contacts 20 include receptacles (not shown) that are configured to receive pins (not shown) of the corresponding signal contacts of the complementary electrical connector therein.

In the illustrated embodiment, the signal module 16 terminates an electrical cable 26. Specifically, the electrical cable 26 includes electrical conductors 52 and an electrically insulative jacket 54 that surrounds the electrical conductors 52. The electrical conductors 52 may be electrically isolated from each other within the jacket 54, for example each of the electrical conductors 52 may include a surrounding layer of electrical insulation 56 that electrically isolates the electrical conductor 52 from the other electrical conductors 52. In the illustrated embodiment, the electrical cable 26 includes four electrical conductors 52 that are arranged in two differential pairs 58. In other embodiments, the electrical cable 26 may include a different number of differential pairs 58 and/or a different number of the electrical conductors 52.

The termination ends 48 of the signal contacts 20 are configured to be terminated to ends 60 of corresponding electrical conductors 52 of the electrical cable 26. Accordingly, the differential pairs 18 of the signal contacts 20 terminate the corresponding differential pairs 58 of the electrical cable 26. In the illustrated embodiment, the termination ends 48 of the signal contacts 20 include crimp barrels 62 that are configured to be crimped to the corresponding conductor ends 60 such that the termination ends 48 are engaged in electrical connection with the corresponding conductors ends 60. But, the termination ends 48 may additionally or alternatively include any other structure that enables the termination ends 48 of the signal contacts 20 to be electrically connected to the ends 60 of the corresponding electrical conductors 52.

Instead of terminating the electrical cable 26, in some alternative embodiments the signal module 16 is configured to be mounted to a PCB and/or other electrical component.

Specifically, the termination ends 48 of the signal contacts 20 may be configured to engage in electrical connection with corresponding electrical contacts (not shown) of the PCB and/or other electrical component. For example, the termination ends 48 of the signal contacts 20 may be configured as press-fit contacts, solder tails, surface mounts, and/or the like for engaging in electrical connection with the corresponding electrical contact of the PCB and/or other electrical component.

The signal module 16 may include one or more electrically insulative central dividers (not shown) and/or other structures that electrically isolate the signal contacts 20 from each other. The central divider may have any shape and may extend along any portion(s) of the lengths of the signal contacts 20 that enables the central divider to electrically isolate the signal contacts 20 from each other.

Optionally, the signal module 16 includes a dielectric housing (not shown) that extends around the termination ends 48 of the signal contacts 20 and optionally extends along a portion of the lengths of the mating ends 46 of the signal contacts 20. The central divider may be a separate component from the dielectric housing or may be an integral structure that extends from (e.g., is connected to the housing or is formed with the housing as a unitary body) the housing.

Referring again to FIG. 1, in the illustrated embodiment, the two signal contacts 20 that define each differential pair 18 of each signal module 16 are arranged in a vertical (as viewed in FIG. 1) column. Alternatively, the two signal contacts 20 of each differential pair 18 of each signal module 16 are arranged in a horizontal (as viewed in FIG. 1) row.

Figure 3:
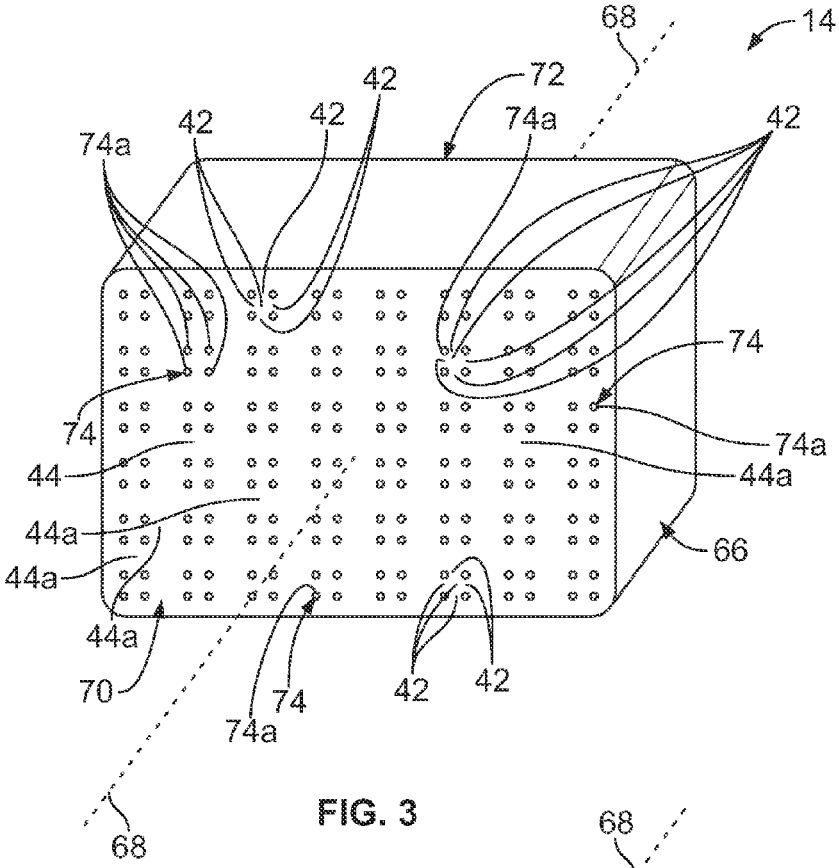
FIG. 3 is a perspective view of an embodiment of an electrically conductive insert of the electrical connector shown in FIG. 1.
Figure 4:
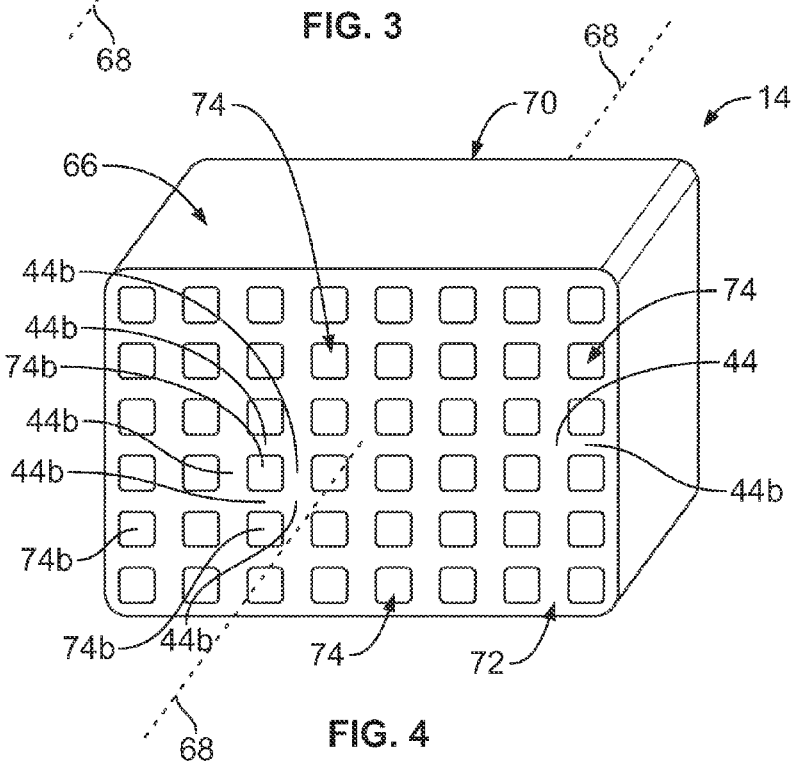
FIG. 4 is another perspective view of the electrically conductive insert shown in FIG. 3 viewed from a different angle than FIG. 3.

FIGS. 3 and 4 are perspective views of an embodiment of an electrically conductive insert 14. The electrically conductive insert 14 includes a body 66 that extends a length along a central longitudinal axis 68 from a mating face 70 to a termination face 72 that is opposite the mating face 70. The body 66 of the electrically conductive insert 14 includes a plurality of module openings 74 that extend through the length of the body 66. Specifically, and as can be seen in FIG. 4, the module openings 74 extend into the body 66 through the termination face 72 of the body 66. As can be seen in FIG. 3, each module opening 74 includes four contact openings 74*a* (not visible in FIG. 4) that extend into the body 66 through the mating face 70.

Figure 10:
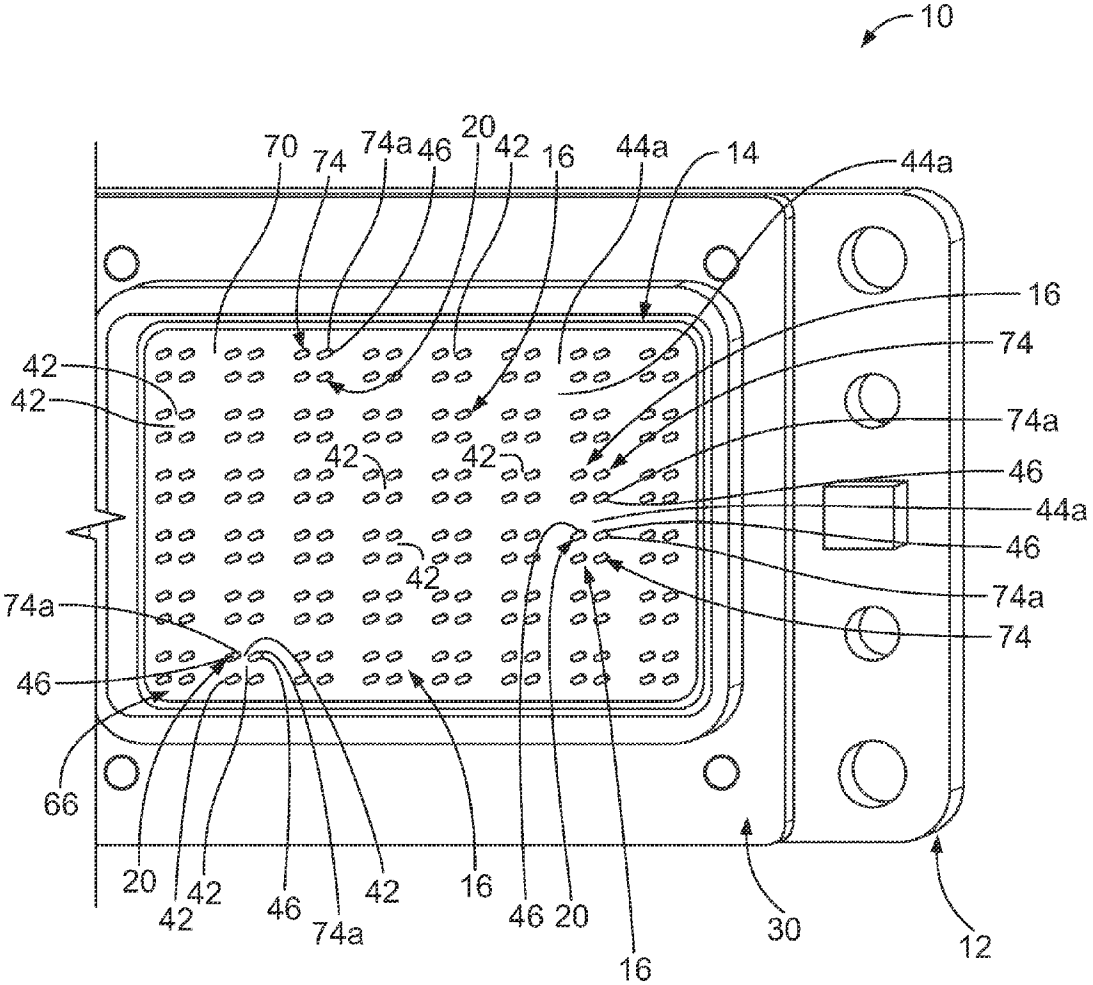
FIG. 10 is an elevational view of a portion of the electrical connector shown in FIG. 1.

Although shown as having the general shape of a parallelepiped, the body 66 of the electrically conductive insert 14 may additionally or alternatively include any other shape. The shape of the body 66 of the electrically conductive insert 14 may or may not be complementary to the shape of the corresponding receptacle 36 (FIG. 1) of the housing 12 (FIGS. 1, 9, and 10).

As will be described below, the signal modules 16 (FIGS. 1, 2, 9, and 10) are received within the corresponding module openings 74 such that the signal contacts 20 (FIGS. 1, 2, 9, and 10) of the signal modules 16 extend within corresponding contact openings 74*a* of the corresponding module openings 74. Specifically, the mating ends 46 (FIGS. 2 and 10) of the signal contacts 20 extend within the corresponding contact openings 74*a* and outward from the mating face 70. Although each module opening 74 is shown herein (e.g., in FIG. 3) as including four contact openings 74*a*, each module opening 74 may include any other number of contact openings 74*a*, which will depend on the number of signal contacts 20 of the corresponding signal module 16.

Figure 6:
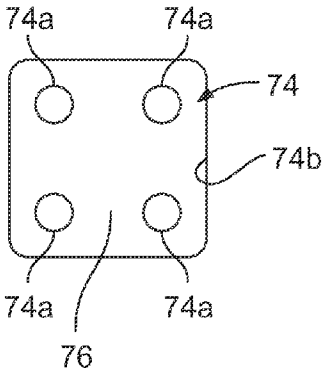
FIG. 6 is an elevational view of an embodiment of a module opening of the electrically conductive insert shown in FIGS. 3-5.
Figure 5:
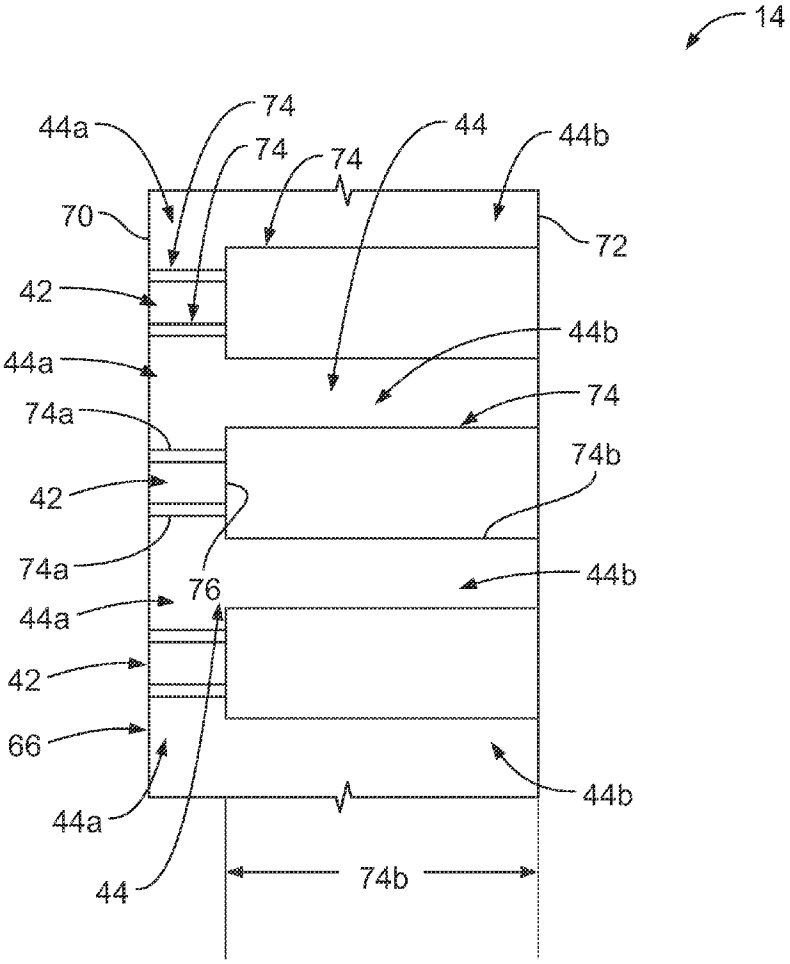
FIG. 5 is a cross-sectional view of a portion of the electrically conductive insert shown in FIGS. 3 and 4.

FIG. 5 is a cross-sectional view of a portion of the electrically conductive insert 14 illustrating the path and geometry of the module opening 74 through the length of the body 66. Each module opening 74 includes a termination segment 74*b* that extends into the body 66 through the termination face 72. The termination segment 74*b* extends into the body 66 to an end wall 76 of the termination segment 74*b*. At the end wall 76, the module opening 74 divides into the four separate contact openings 74*a*. Specifically, the contact openings 74*a* extend through the end wall 76 of the termination segment 74*b*, through the body 66 between the end wall 76 and the mating face 70, and through the mating face 70. FIG. 5 only illustrates two of the four contact openings 74*a* of each module openings 74 that is shown in FIG. 5. FIG. 6 is an elevational view of one of the module openings 74 that better illustrates the division of the module opening 74 into the four contact openings 74*a* at the end wall 76.

Referring now to FIGS. 3-5, the electrically conductive segments 42 of the body 66 of the electrically conductive insert 14 extend between, and thereby separate, adjacent contact openings 74*a* of the same module opening 74. The electrically conductive segments 42 are not visible in FIG. 4. The body 66 of the electrically conductive insert 66 includes the electrically conductive segments 44, which include electrically conductive segments 44*a* that extend between, and thereby separate, the contact openings 74*a* of adjacent module openings 74. The electrically conductive segments 44*a* are not visible in FIG. 4. Moreover, the electrically conductive segments 44 include electrically conductive segments 44*b* of the body 66 that extend between, and thereby separate, the termination segments 74*b* of adjacent module openings 74. The electrically conductive segments 44*b* are not visible in FIG. 3. The electrically conductive segments 44*a* and 44*b* may each be referred to herein as "first" electrically conductive segments. The electrically conductive segments 42 may each be referred to herein as "second" electrically conductive segments.

The electrically conductive segments 42 and 44 of the body 66 may be provided as electrically conductive (i.e., the property of conducting electrical energy) by fabricating the body 66 using any structure, arrangement, configuration, materials, and/or the like. For example, in the illustrated embodiment of the electrically conductive insert 14, the body 66 is fabricated from a solid body of one or more metals and/or metal alloys, such as, but not limited to, aluminum, an aluminum alloy, copper, a copper alloy, silver, a silver alloy, gold, a gold alloy, steel, a steel alloy, and/or the like. The segments 42 and 44 of the body 66 are thus provided with electrical conductivity from the solid metallic material that defines the body 66.

Figure 7:
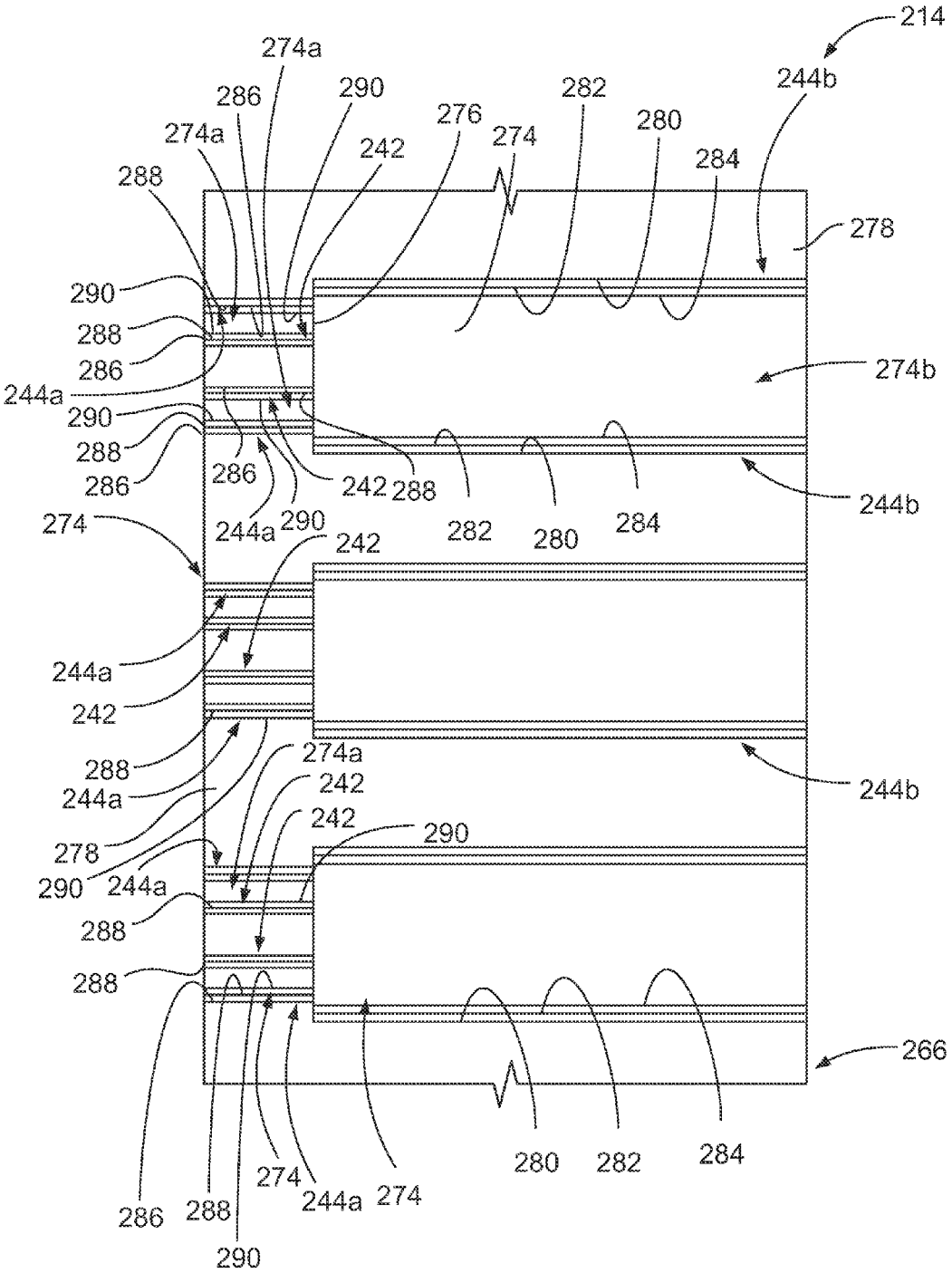
FIG. 7 is a cross-sectional view of a portion of another embodiment of an electrically conductive insert.

Another example of providing the electrically conductive segments 42 and 44 of the body 66 as electrically conductive includes fabricating the body 66 from a dielectric base (e.g., fabricated from a polymer, a plastic, a composite material, and/or the like) that is coated with an electrically conductive coating. For example, FIG. 7 is a cross-sectional view of a portion of another embodiment of an electrically conductive insert 214 that includes a body 266 having a dielectric base 278. The dielectric base 278 includes a plurality of module openings 274. Each module opening 274 includes a termination segment 274*b* that extends into the body 266 to an end wall 276 of the termination segment 274*b*. At the end wall 276, the module opening 274 divides into the four separate contact openings 274*a*.

As can be seen in FIG. 7, surfaces 280 of the dielectric base 278 that define the termination segments 274*b* of the module openings 274 are coated with an electrically conductive coating 282. The electrically conductive coating 282 provides electrically conductive segments 244*b* that extend between, and thereby separate, the termination segments 274*b* of adjacent module openings 274. An electrically insulative layer 284 may extend on the electrically conductive coating 282 to electrically isolate the corresponding signal contacts 20 from the electrically conductive coating 282.

Surfaces 286 of the of the dielectric base 278 that define the contact openings 274*a* of the module openings 274 are coated with an electrically conductive coating 288. The electrically conductive coating 288 provides electrically conductive segments 242 that extend between, and thereby separate, adjacent contact openings 274*a* of the same module opening 274. An electrically insulative layer 290 may extend on the electrically conductive coating 288 to electrically isolate the corresponding signal contacts 20 from the electrically conductive coating 288. The electrically conductive coating 288 may also provide electrically conductive segments 244*a* that extend between, and thereby separate, the contact openings 274*a* of adjacent module openings 274. The electrically conductive segments 244*a* and 244*b* may each be referred to herein as "first" electrically conductive segments. The electrically conductive segments 242 may each be referred to herein as "second" electrically conductive segments.

The electrically conductive coatings 282 and 288 may each be applied on dielectric base 278 using any method, process, structure, means, and/or the like. Examples of suitable processes for applying the electrically conductive coatings 282 and 288 include, but are not limited to, chemical solution deposition (CSD), chemical vapor deposition (CVD), physical vapor deposition (PVD), atomic layer deposition (ALD), electrodeposition, electrocoating, electroplating, screen printing, dip coating, aerosol coating, spin coating, sputtering, and/or the like. As used herein, each of the electrically conductive coatings 282 and 288 is considered to be coating when the electrically conductive coating 282 and/or 288 is applied on the dielectric base 278 using a plating process. In some alternative embodiments, the electrically conductive segments 242, 244*a*, and/or 244*b* are provided by one or more shells (not shown) that are mounted to the dielectric base 278 in place of the coatings 282 and/or 288.

Figure 8:
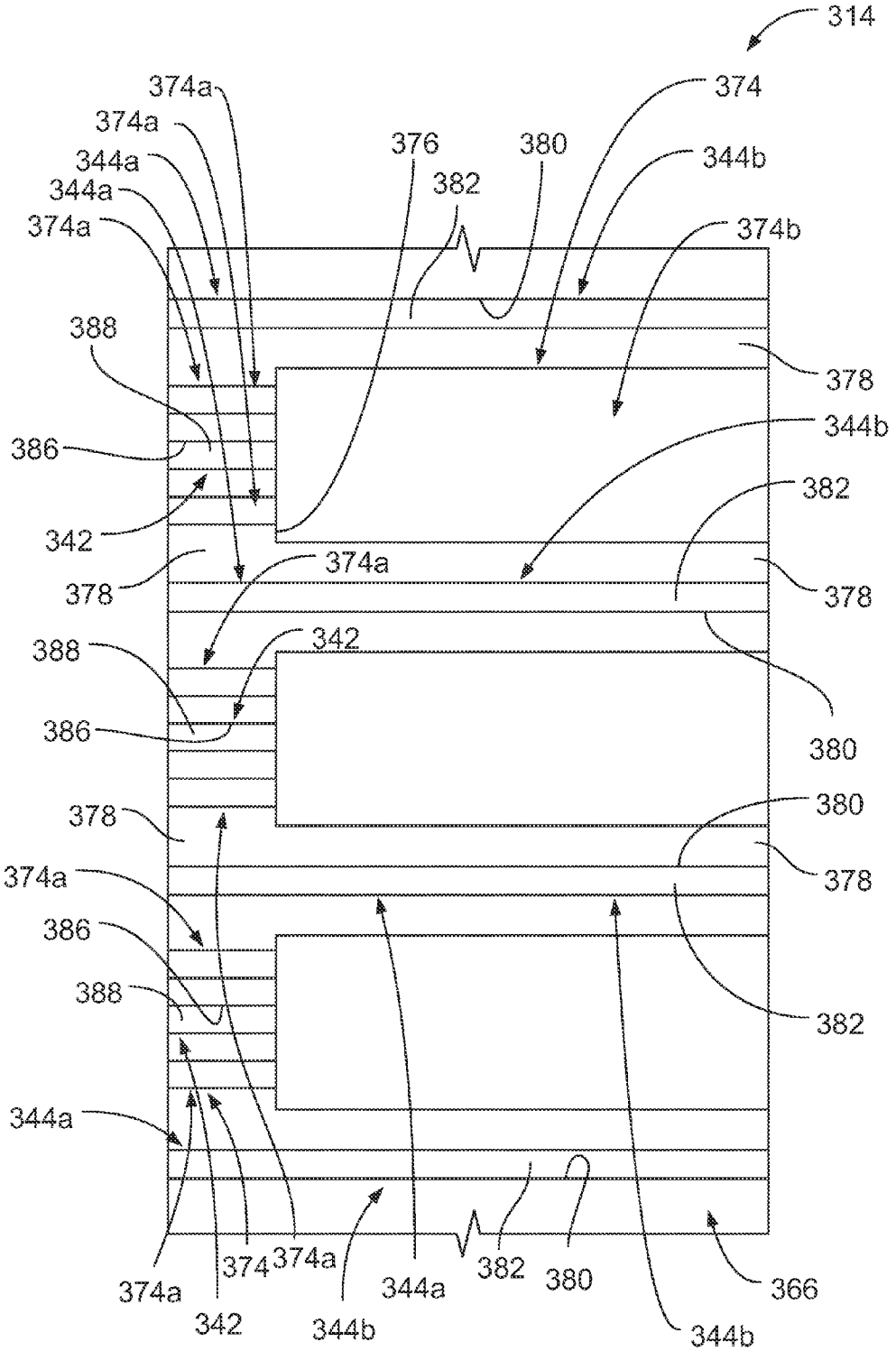
FIG. 8 is a cross-sectional view of a portion of another embodiment of an electrically conductive insert.

Yet another example of providing the electrically conductive segments 42 and 44 of the body 66 of the electrically conductive insert 14 includes fabricating the body 66 from a dielectric base (e.g., fabricated from a polymer, a plastic, a composite material, and/or the like) that is at least partially filled with one or more electrically conductive materials. For example, FIG. 8 is a cross-sectional view of a portion of another embodiment of an electrically conductive insert 314 that includes a body 366 having a dielectric base 378. The dielectric base 378 includes a plurality of module openings 374. Each module opening 374 includes a termination segment 374*b* that extends into the body 366 to an end wall 376 of the termination segment 374*b*. At the end wall 376, the module opening 374 divides into the four separate contact openings 374*a*.

The dielectric base 378 includes one or more channels 380 that are at least partially filled with an electrically conductive material 382, such as, but not limited to, one or more metals, metal alloys, and/or the like. The electrically conductive material 382 may be in a solid state, a gaseous state, a liquid state, or another state. The electrically conductive material 382 within the channels 380 provides electrically conductive segments 344*b* that extend between, and thereby separate, the termination segments 374*b* of adjacent module openings 374. The electrically conductive material 382 within the channels 380 may also provide electrically conductive segments 344*a* that extend between, and thereby separate, the contact openings 374*a* of adjacent module openings 374.

The dielectric base 378 also includes one or more channels 386 that are at least partially filled with an electrically conductive material 388, such as, but not limited to, one or more metals, metal alloys, and/or the like. The electrically conductive material 388 may be in a solid state, a gaseous state, a liquid state, or another state. The electrically conductive material 388 within the channels 386 provides electrically conductive segments 342 that extend between, and thereby separate, adjacent contact openings 374*a* of the same module opening 374. The electrically conductive segments 344*a* and 344*b* may each be referred to herein as "first" electrically conductive segments. The electrically conductive segments 342 may each be referred to herein as "second" electrically conductive segments.

FIG. 9 is a perspective view of a portion of the electrical connector 10 illustrating the termination side 32 of the housing 12 and the terminating face 72 of the electrically conductive insert 14. The signal modules 16 of the sub-connector 38*a* are held by the electrically conductive insert 14 and the electrical cables 26 are terminated by the signal modules 16. In the illustrated embodiment, the electrical cables 26 are shown as individual cables that are separate and discrete components from each other. But, some or all of the electrical cables 26 may be grouped together in one or more larger cables. In other words, some or all of the electrical cables 26 may be contained within a jacket (not shown) of one or more larger cables.

The signal modules 16 are received within the module openings 74 of the electrically conductive insert 14. Specifically, in the illustrated embodiment, the termination ends 48 of the signal contacts 20 of each signal module 16 extend within the termination segments 74*b* of the corresponding module openings 74. The termination ends 48 of the signal contacts 20 are terminated to the corresponding electrical conductors 52 of the corresponding electrical cable 26. In the illustrated embodiment, the termination ends 48 are terminated to the corresponding electrical conductors 52 within the corresponding termination segments 74*b*, such that the ends 60 of the electrical conductors 52 extend within the corresponding termination segments 74*b*. But, in other embodiments, the termination ends 48 of the signal contacts 20 extend past the termination face 72 of the electrically conductive insert 14 for termination to the corresponding electrical conductors 52 at least partially outside the termination segments 74*b* of the corresponding module openings 74.

The signal modules 16 are received within the corresponding module openings 74 such that the optional central divider of each signal module 16 extends within the termination segment 74*b* of the corresponding module opening 74. When the signal modules 16 are provided with the optional housings, the housings extend within the termination segments 74*b* of the corresponding module openings 74.

As can be seen in FIG. 9, the electrically conductive segments 44*b* of the body 66 of the electrically conductive insert 14 extend between, and thereby separate, the termination segments 74*b* of adjacent module openings 74. The electrically conductive segments 44*b* thus extend between adjacent signal modules 16 such that the electrically conductive segments 44*b* electrically isolate the adjacent signal modules 16 from each other. Specifically, the electrically conductive segments 44*b* extend between the termination ends 48 of the signal contacts 20 of adjacent signal modules 16 such that the electrically conductive segments 44*b* electrically isolate the termination ends 48 of the signal contacts 20 of adjacent signal modules 16 from each other. The body 66 of the electrically conductive insert 14 may be engaged in electrical connection with one or more sources of electrical energy (e.g., a ground shield (not shown) of an electrical cable 26 and/or a larger electrical cable that includes the ground shield, a ground circuit (not shown) of a PCB and/or other electrical component, and/or the like) to energize the electrically conductive segments 44*b* and thereby enable the electrically conductive segments 44*b* to provide the electrical isolation described herein.

FIG. 10 is an elevational view of a portion of the electrical connector 10 illustrating the mating side 30 of the housing 12 and the mating face 70 of the electrically conductive insert 14. The signal modules 16 are received within the module openings 74 of the electrically conductive insert 14 such that the mating ends 46 of the signal contacts 20 of each signal module 16 extend within the corresponding contact openings 74*a* of the corresponding module opening 74 and outward along the mating face 70.

As can be seen in FIG. 10, the electrically conductive segments 44*a* of the body 66 of the electrically conductive insert 14 extend between, and thereby separate, the contact openings 74*a* of adjacent module openings 74. The electrically conductive segments 44*a* thus extend between adjacent signal modules 16 such that the electrically conductive segments 44*a* electrically isolate the adjacent signal modules 16 from each other. Specifically, the electrically conductive segments 44*a* extend between the mating ends 46 of the signal contacts 20 of adjacent signal modules 16 such that the electrically conductive segments 44*a* electrically isolate the mating ends 46 of the signal contacts 20 of adjacent signal modules 16 from each other.

As can also be seen in FIG. 10, the electrically conductive segments 42 of the body 66 of the electrically conductive insert 14 extend between, and thereby separate, adjacent contact openings 74*a* of the same module opening 74. The electrically conductive segments 42 thus extend between adjacent signal contacts 20 of a signal module such that the electrically conductive segments 42 electrically isolate adjacent signal contacts 20 of the same signal module 16 from each other. Specifically, the electrically conductive segments 42 extend between the mating ends 46 of adjacent signal contacts 20 of the same signal module 16 such that the electrically conductive segments 42 electrically isolate the mating ends 46 of adjacent signal contacts 20 of the same signal module 16 from each other.

The body 66 of the electrically conductive insert 14 may be engaged in electrical connection with one or more sources of electrical energy (e.g., a ground shield (not shown) of an electrical cable 26 and/or a larger electrical cable that includes the ground shield, a ground circuit (not shown) of a PCB and/or other electrical component, and/or the like) to energize the electrically conductive segments 42 and/or 44*a* and thereby enable the electrically conductive segments 42 and/or 44*a* to provide the electrical isolation described herein.

The electrical connector 10 may be configured to conduct electrical data signals at least 1 GbE, at least 10 GbE, less than 10 GbE, greater than 10 GbE, and/or the like. The embodiments described and/or illustrated herein may provide an electrical connector that can conduct electrical data signals at a greater rate than known similarly-sized electrical connectors. In other words, the embodiments described and/or illustrated herein may provide an electrical connector that conducts electrical data signals at an increased rate for a given size of the electrical connector. For example, the electrical isolation provided by the electrically conductive segments (e.g., the electrically conductive segments 42, 44*a*, 44*b*, 242, 244*a*, 244*b*, 342, 344*a*, and 344*b*) of the electrically conductive inserts described and/or illustrated herein (e.g., the inserts 14, 214, and 314) may enable the electrical connector to include a greater density (and thus a greater number) of the signal modules 16 for a given size of the electrical connector. For example, in the illustrated embodiment, the electrical isolation provided by the electrically conductive segments of the electrically conductive inserts described and/or illustrated herein enables the electrically conductive insert 14 of the sub-connector 38 to holds 48 of the signal modules 16 (e.g., as compared to 11 signal modules of at least some known similarly-sized electrical connectors.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing having a receptacle;

an electrically conductive insert held by the housing within the receptacle, the electrically conductive insert having a body that extends between a mating face and a termination face, the electrically conductive insert defining a plurality of module openings that extend through the body, the module openings each including a termination segment that extends from the terminating face into the body to an end wall, the module openings each further including four contact openings that extend from the mating face into the body through the end wall and are open to the respective termination segment, the electrically conductive insert comprising electrically conductive segments that extend between adjacent module openings; and a plurality of signal modules held by the electrically conductive insert, each signal module having two differential pairs of electrical contacts, the signal modules being held by the electrically conductive insert such that the electrical contacts of each signal module extend within a corresponding module opening, wherein the electrically conductive segments of the electrically conductive insert extend between adjacent signal modules to electrically isolate the electrical contacts of the adjacent signal modules from each other.

2. The electrical connector of claim 1, wherein the electrically conductive segments are first electrically conductive segments, the electrically conductive insert comprising second electrically conductive segments that extend between adjacent contact openings in a corresponding module opening, each electrical contact of each signal module extending within a corresponding contact opening of the corresponding module opening, wherein the second electrically conductive segments of the electrically conductive insert extend between adjacent electrical contacts of the corresponding signal modules to electrically isolate the adjacent electrical contacts from each other.

3. The electrical connector of claim 1, wherein the electrically conductive insert comprises a dielectric base, the electrically conductive segments comprising a coating that coats the dielectric base.

4. The electrical connector of claim 1, wherein the electrically conductive insert comprises a metallic body.

5. The electrical connector of claim 1, wherein the electrically conductive insert comprises a dielectric base that is at least partially filled with an electrically conductive material, the electrically conductive segments being defined by the electrically conductive material that at least partially fills the dielectric base.

6. The electrical connector of claim 1, wherein the electrical connector is configured to conduct electrical data signals at a rate of at least approximately 1 Gigabit Ethernet (GbE).

7. The electrical connector of claim 1, wherein the electrical connector is configured to conduct electrical data signals at a rate of at least approximately 10 Gigabit Ethernet (GbE).

8. The electrical connector of claim 1, wherein each signal module is configured to be terminated to a corresponding cable that has two differential pairs of electrical conductors such that the differential pairs of the electrical contacts of the signal module terminate the differential pairs of the electrical conductors of the corresponding cable.

9. The electrical connector of claim 1, wherein each signal module is configured to be mounted to a printed circuit board (PCB) such that the electrical contacts of the signal module are engaged in electrical connection with corresponding electrical contacts of the PCB.

10. The electrical connector of claim 1, wherein the electrically conductive segments that extend between adjacent module openings are located at least one of between the termination segments of adjacent module openings or between the contact openings of adjacent module openings.

11. An electrical connector comprising:

a housing having a receptacle;

an electrically conductive insert held by the housing within the receptacle, the electrically conductive insert comprising a plurality of module openings, each module opening having four contact openings, the electrically conductive insert comprising first electrically conductive segments that extend between adjacent module openings and second electrically conductive segments that extend between adjacent contact openings; and a plurality of signal modules held by the electrically conductive insert, each signal module having two differential pairs of electrical contacts, the signal modules being held by the electrically conductive insert within corresponding module openings such that each electrical contact of each signal module extends within a corresponding contact opening of the corresponding module opening, wherein the first and second electrically conductive segments of the electrically conductive insert extend between adjacent module openings and adjacent contact openings, respectively.

12. The electrical connector of claim 11, wherein the electrically conductive insert comprises a dielectric base, the first and second electrically conductive segments comprising a coating that coats the dielectric base.

13. The electrical connector of claim 11, wherein the electrically conductive insert comprises a metallic body.

14. The electrical connector of claim 11, wherein the electrically conductive insert comprises a dielectric base that is at least partially filled with an electrically conductive material, the first and second electrically conductive segments being defined by the electrically conductive material that at least partially fills the dielectric base.

15. The electrical connector of claim 11, wherein the electrical connector is configured to conduct electrical data signals at a rate of at least approximately 10 Gigabit Ethernet (GbE).

16. The electrical connector of claim 11, wherein the electrically conductive insert holds 48 of the signal modules.

17. The electrical connector of claim 11, wherein the electrically conductive insert has a body that extends between a mating face and a termination face, each module opening including a termination segment that extends from the terminating face into the body to an end wall that is between the mating face and the termination face, the four contact openings of each module opening extending from the mating face into the body through the end wall and being open to the respective termination segment.

18. An electrical connector comprising:

a housing having a receptacle;

an electrically conductive insert held by the housing within the receptacle, the electrically conductive insert comprising a metallic body that extends between a mating face and a termination face, the electrically conductive insert defines a plurality of module openings that extend through the metallic body, the module openings each including a termination segment that extends from the terminating face into the metallic body to an end wall, the module openings each further including four contact openings that extend from the mating face into the metallic body through the end wall and are open to the respective termination segment, the metallic body of the electrically conductive insert comprising electrically conductive segments that extend between adjacent module openings; and a plurality of signal modules held by the electrically conductive insert, each signal module having two differential pairs of electrical contacts, the signal modules being held by the electrically conductive insert such that the electrical contacts of each signal module extend within a corresponding module opening, wherein the electrically conductive segments of the electrically conductive insert extend between adjacent signal modules to electrically isolate the electrical contacts of the adjacent signal modules from each other.

19. The electrical connector of claim 18, wherein the electrically conductive segments are first electrically conductive segments, the electrically conductive insert comprising second electrically conductive segments that extend between adjacent contact openings in a corresponding module opening, each electrical contact of each signal module extending within a corresponding contact opening of the corresponding module opening, wherein the second electrically conductive segments of the electrically conductive insert extend between adjacent electrical contacts of the corresponding signal modules to electrically isolate the adjacent electrical contacts from each other.

20. The electrical connector of claim 18, wherein the electrical connector is configured to conduct electrical data signals at a rate of at least approximately 10 Gigabit Ethernet (GbE).

* * * * *